United States Patent [19]

Katoh et al.

[11] Patent Number: 4,561,147

[45] Date of Patent: Dec. 31, 1985

[54] HINGE WHICH FACILITATES OPENING DOOR AFTER THE GATE FRAME IS DISTORTED

[75] Inventors: Yoshiaki Katoh; Hiroshi Inuzuka, both of Tokyo, Japan

[73] Assignee: Miwa Lock Co. Ltd., Tokyo, Japan

[21] Appl. No.: 564,739

[22] Filed: Dec. 22, 1983

[30] Foreign Application Priority Data

| | | | |
|---|---|---|---|
| Dec. 27, 1982 | [JP] | Japan | 57-232539 |
| Jun. 20, 1983 | [JP] | Japan | 58-109350 |
| Jun. 27, 1983 | [JP] | Japan | 58-116578 |
| Jul. 5, 1983 | [JP] | Japan | 58-121077 |
| Jul. 25, 1983 | [JP] | Japan | 58-136364 |

[51] Int. Cl.[4] ..... E05D 5/12

[52] U.S. Cl. ..... 16/380; 16/277

[58] Field of Search ..... 16/380, 381, 386, 254–256, 16/229, 261–263, 265, 266, 260, 277, 304, 309, 257, 260, 242, 243

[56] References Cited

U.S. PATENT DOCUMENTS

| | | | |
|---|---|---|---|
| 114,813 | 5/1871 | Hawkes | 16/256 |
| 698,216 | 4/1902 | Newman | 16/229 |
| 2,207,836 | 7/1940 | Sundell | 16/256 |
| 2,430,942 | 11/1947 | McGiff | 16/229 |
| 4,307,486 | 12/1981 | Matsumoto | 16/261 |

FOREIGN PATENT DOCUMENTS

| | | | |
|---|---|---|---|
| 634053 | 1/1962 | Canada | 16/256 |
| 138969 | 2/1903 | Fed. Rep. of Germany | 16/229 |
| 174317 | 3/1953 | Fed. Rep. of Germany | 16/256 |
| 58-41875 | 3/1983 | Japan . | |
| 58-31365 | 3/1983 | Japan . | |
| 58-41876 | 3/1983 | Japan . | |

*Primary Examiner*—Donald R. Schran
*Assistant Examiner*—James L. Wolfe
*Attorney, Agent, or Firm*—Spencer & Frank

[57] ABSTRACT

A door hinge of the type comprising a first metal plate having one vertical side edge formed integral with a pin and a second metal piece having one vertical side edge formed integral with a second knuckle cylinder into which is fitted the pin. A load plug is slideably fitted into the second knuckle cylinder for engagement with the upper end of the pin and the second knuckle cylinder is formed with an engaging portion for preventing the load plug from being displaced from a predetermined position. A compression spring means is loaded in the second knuckle cylinder above the load plug so as to press the load plug against the engaging portion, whereby a load applied axially to the pin is carried by the compression spring means through the load plug. When the upper or lower side edge of the door interferes with a gate frame due to an earthquake or the like, the first and second plate metals are caused to move toward or away from each other so that the interference between the door and the gate frame is eliminated and the door is moved upwardly or downwardly relative to the gate frame. Therefore even when the gate frame is distorted, the door can be positively opened.

16 Claims, 18 Drawing Figures

HINGE WHICH FACILITATES OPENING DOOR AFTER THE GATE FRAME IS DISTORTED

BACKGROUND OF THE INVENTION

The present invention relates generally to a hinge for a door and more particularly to an earthquake-proof hinge which can positively permit the door to be opened even when the gate frame of the door is distorted and interferes with the door due to an earthquake or the like.

When a gate frame is distorted due to the impact of an earthquake or gas explosion, the gate frame interferes with the door so that the door cannot be opened. Needless to say, a very dangerous condition exists when a fire occurs and a door is kept closed.

The reason why the door cannot be opened when the gate frame is distorted will be described with reference to FIGS. 1, 2 and 3. It is assumed that forces are exerted in a plane containing a gate frame 1 so that the gate frame 1 is distorted into the form of a parallelogram. When the lower side of the gate frame 1 is assumed to be held stationary, the forces exerted on the gate frame 1 may be divided into a force ⊕ which is directed from the knob 2 of the door 4 to the hinges 3 and a force ⊖ which is directed from the hinges 3 to the knob 2. When the force is exerted on the gate frame in the direction ⊕, the gate frame 1 is distorted as shown in FIG. 2. That is, the upper side edge of the door 4 strongly interferes with the upper side of the gate frame 1. As a result, the door 4 cannot be opened due to the distortions of the door 4 and the gate frame 1 and to the frictional forces therebetween. On the other hand, when the force or impact is exerted in the direction ⊖, the gate frame 1 is distorted as shown in FIG. 3. That is, the lower side edge of the door 4 strongly interferes with the lower side of the gate frame 1.

In general, the clearance or spacing $\beta$ between the lower side edge of the door 4 and the gate frame is, for instance, about six millimeters and is greater than the clearance or spacing $\alpha$ between the gate frame 1 and the upper side edge of the door 4 which is, for instance, about three millimeters. As a result, the tolerance $\gamma$ in the horizontal direction (See FIG. 2) allowed when the force is applied in the direction ⊕ is less than the tolerance $\delta$ (See FIG. 3) allowed when the force is applied in the direction ⊖.

Referring to FIG. 4, the conventional so-called "flag" hinge has a first metal plate 5 which is attached to a gate frame 1 and has one vertical side edge formed integral with a pin 6. The hinge also comprises a second metal plate 7 which is attached to a door and has one vertical side edge formed integral with a knuckle cylinder 8 into which is rotatably fitted the pin 6. The load of the door which is axially applied to the pin 6 is carried by the engagement of the upper end of the pin 6 with the top of the knuckle cylinder 8. As a result, the door 4 can be moved upwardly relative to the gate frame.

It follows therefore that when a force is applied to the frame 1 in the direction ⊕, the horizontal tolerance $\delta$ is increased so that when the force is applied in the direction ⊕, the door can be opened even when the gate frame 1 is distorted. However, as shown in FIG. 2, when the force is applied in the direction ⊖, the door 4 cannot be opened even when the gate frame 1 is only slightly distorted. This is very dangerous as described before.

In order to overcome the above described problem, the doors are so designed and constructed that there may be a clearance or spacing of the order of 10 mm between the door and the gate frame. But such countermeasure cannot be applied to existing doors. Furthermore, the outer appearance is degraded and air-tightness cannot be maintained.

SUMMARY OF THE INVENTION

The primary object of the present invention is therefore to provide an earthquake-proof hinge which permits a door can be positively opened even when a gate frame is distorted due to the impact of an earthquake or the like.

Another object of the present invention is to provide an earthquake-proof hinge which can be applied to existing doors.

To the above and other ends, the present invention provides an earthquake-proof hinge of the type comprising a first metal plate having one vertical side edge is formed integral with a first knuckle cylinder, a second metal plate having one vertical side edge formed integral with a second knuckle cylinder and a pin extended through said first and second knuckle cylinders, characterized in that a load plug which engages with the upper end of said pin is slidably fitted into said second knuckle cylinder, an engaging portion for receiving said load plug is formed within said second knuckle cylinder so that said load plug is prevented from falling down, and a compression spring means is loaded within said second knuckle cylinder above said load plug, whereby said load plug is pressed against said engaging portion and a load axially applied to said pin is carried by said compression spring means.

According to the present invention, therefore, even when the gate frame is distorted so that it interferes with the door, the door can be moved vertically relative to the gate frame in a direction such that interference between the door and the gate frame is eliminated. Therefore, even when the gate frame is distorted due to the impact of an earthquake or the like, the door can be positively opened.

The inventors considered that the inclination of the gate frame relative to the vertical may be used to express the distortion of the gate frame and made extensive studies and experiments so as to investigate the relationship between the distortion of the gate frame and the force required for opening the door under various conditions. The results showed that when conventional hinges are used and a force is applied to the gate frame in the direction ⊕ as shown in FIG. 2, so that the gate frame is only inclined by 4/1000, the force required for opening the door reaches as high as 100 Kg which is the limit that a man can produce. On the other hand, when the earthquake-proof hinges in accordance with the present invention are used, the force required for opening the door is only 15–35 Kg even when the side edge of the gate frame is inclined by 10/1000 as shown in FIG. 2.

The hinge in accordance with the present invention is earthquake-proof in that even when the gate frame is distorted, the door can be easily opened. In addition, the hinges in accordance with the present invention can readily replace existing conventional hinges so that existing doors can be made earthquake-proof.

In the cases of the conventional hinges, when a plurality of hinges are used to support a door, the load of the door tends to be concentrated upon one hinge unless the first and second metal plates of the hinges are correctly attached to the gate frame and the door. However, according to the present invention, when the load of the door is concentrated on one hinge, the load plug is displaced so that the load plug and the pin of another hinge which have been moved away from each other are caused to move toward each other and engage with each other. As a result, the load of the door can be uniformly or evenly distributed to a plurality of door hinges.

The above and other objects, effects, features and advantages of the present invention will become more apparent from the following description of the preferred embodiments thereof taken in conjunction with the accompanying drawings.

BRIEF DESCRIPTION OF THE DRAWINGS

The same reference numerals are used to designate similar parts throughout the figures.

DETAILED DESCRIPTION OF THE INVENTION

Figure 5:
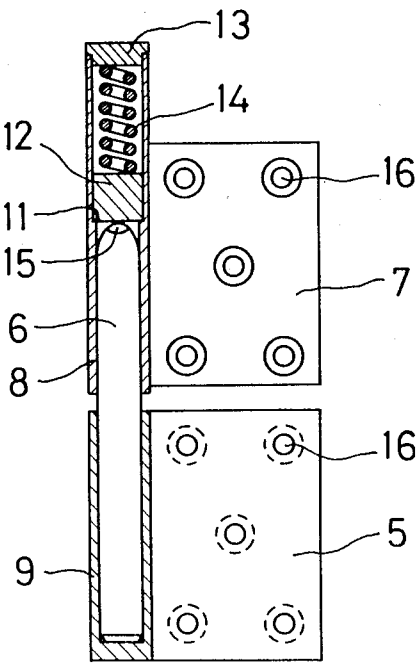

First Embodiment, FIG. 5

Referring to FIG. 5, one long side edge of a first metal plate 5 is in general formed integral with a pin 6 which extends substantially parallel to the one long side edge of the first metal plate 5. In the first embodiment, the one long side edge of the first metal plate 5 is shown as being formed integral with a first knuckle cylinder 9 whose bottom end is closed and the pin 6 is press fitted into the knuckle cylinder 9. The pin 6 extends beyond the upper end of the first knuckle cylinder 9 or the upper side edge of the first metal plate 5.

One side edge of a second metal plate 7 is formed integral with a second knuckle cylinder 8 whose both ends are opened and which extends upwardly beyond the upper side edge of the second metal plate 7.

An engaging step 11 is formed within the second knuckle cylinder 8 at a midpoint between the ends thereof and the pin 6 which is extended upwardly from the first metal plate 5 is rotatably fitted into the lower portion of the second knuckle cylinder 8 below the engaging step 11.

A short cylindrical load plug 12 is axially slidably fitted into the upper portion of the second knuckle cylinder 8 above the engaging step 11. A compression spring 14 is loaded between the load plug 12 and a cap 13 fitted over the upper end of the second knuckle cylinder 8 so that the load plug 12 is pressed against the top of the pin 6 but is prevented from being forced downward by the engaging step 11. It is preferable that the force of the spring 14 be 10–20 Kg greater than the normal load which is one half of the weight of a door (when the door is supported by a pair of earthquake-proof hinges) and which is exerted on the load plug 12. The position of the load plug 12 within the second knuckle cylinder 8 is so determined that the top end of the pin 6 engates with the lower end of the load plug 12 and the distance between the upper end of the first knuckle cylinder 9 and the lower end of the second or upper knuckle cylinder 8 is maintained at about 5–6 mm.

A steel ball 15 is embedded in the upper end of the pin 6 so that the area of contact between the pin 6 and the lower end of the load plug 12 may be minimized. Both the first and second metal plates 5 and 7 are formed with a plurality (five in FIG. 5) of screw holes 16.

It should be noted that if the arrangement of the screw holes 16 of the first and second metal plates 5 and 7 is the same as for conventional hinges, the earthquake-proof hinges in accordance with the present invention can be readily attached to the doors and gate frames without tapping the screw holes, whereby the earthquake-proof hinges can be easily replaced with the existing conventional hinges.

Figure 1:
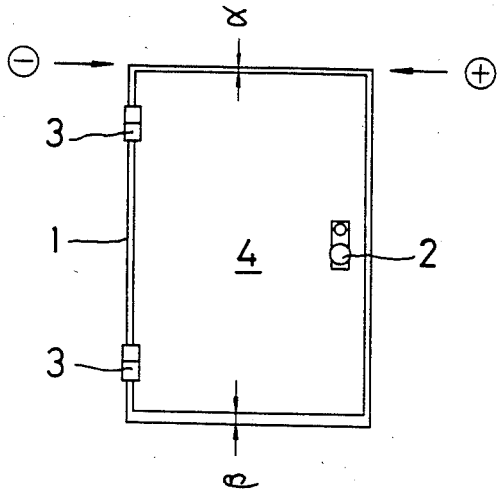
FIG. 1 shows diagrammatically a door and a gate frame.

The first metal plate 5 is securely fixed to the gate frame 1 while the second metal plate 7 is attached, to the door 4 (See FIG. 1).

When the gate frame 1 is not distorted, that is in a normal condition, the load applied to each hinge (it is assumed that two earthquake-proof hinges are used) is about one half of the weight of the door 4 if the earthquake-proof hinges are installed in an ideal manner. This load is supported by the gate frame 1 through the second metal plate 7, the second knuckle cylinder 8, the compression spring 14, the load plug 12 and the pin 6. As described above, the compression spring 14 is preloaded by one half of the weight of the door 4 plus 10–20 Kg. Therefore, compression spring 14 will not distort so that the lower end of the load plug 12 is elastically pressed against the engaging step 11 of the second knuckle cylinder 8. It follows therefore that the load plug 12 is securely disposed within the second knuckle cylinder 8 under normal conditions. And the function of the earthquake-proof hinge is similar to that of conventional hinges.

Figure 2:
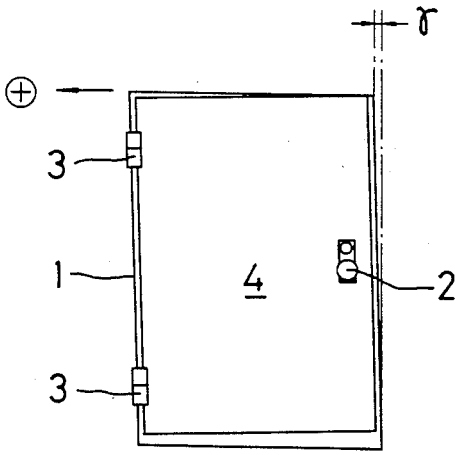
Figure 4:
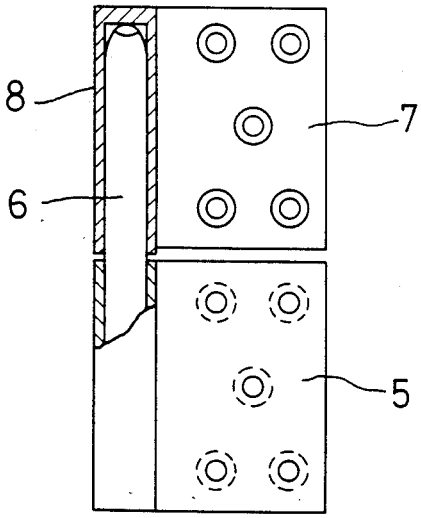
FIG. 4 shows, partly in section, a conventional hinge.

However, assume that impact forces are applied to the gate frame 1. Then, as shown in FIG. 2, if the force is exerted in the direction indicated by ⊕, the gate frame 1 is distorted and consequently the upper side edge of the door 4 is forced into engagement with the gate frame 1. As a result, the reaction force of the force applied to the gate frame 1 is transmitted through the earthquake-proof hinges to the door 4. This force causes the first and second metal plates 5 and 7 to move toward each other so that the compression spring 14 is compressed and consequently the load plug 12 is caused to rise in FIG. 5. Therefore, as best shown in FIG. 2, the door 4 can be moved downwardly with respect to the gate frame 1 so that the interference between the door 4 and the gate frame 1 is eliminated. Thus the door 4 can be easily opened.

Figure 3:
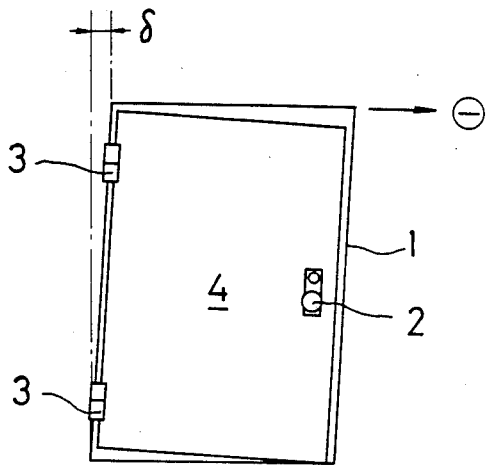
FIGS. 2 and 3 are views used to explain the interference between the door and the gate frame.

Next when the impact is applied to the gate frame 1 in the direction as indicated by ⊖ in FIG. 3, the lower side edge of the door 4 is brought into engagement with the lower side edge of the gate frame 1. Then the force applied to the door 4 is such that the pin 6 is forcibly withdrawn from the second knuckle cylinder 8 (See FIG. 5). As a result, the door 4 is moved upwardly relative to the gate frame 4, whereby the interference between the gate frame 1 and the door 4 is eliminated.

According to the first embodiment, in response to the impact applied in the direction ⊕, the compression spring 14 is deformed so that the load plug 12 is forced to displace itself, but when the impact is relieved, the compression spring 14 returns to its normal state and the load plug 12 is returned to its normal position.

It is apparent that the first metal plate 5 can be fixed to the door and the second metal plate 7 to the gate frame.

Figure 6:
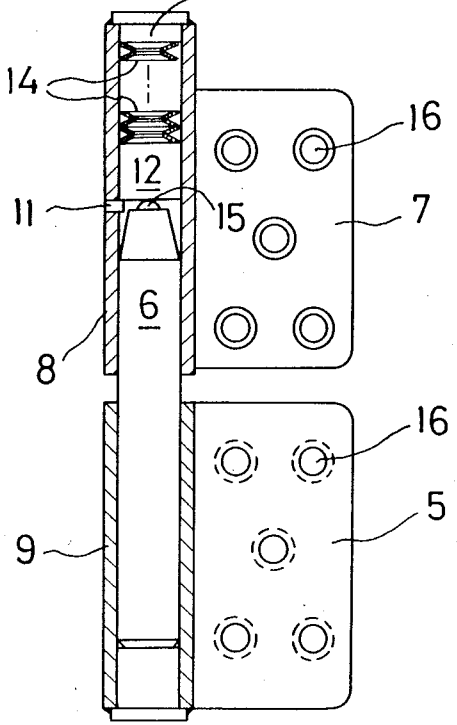

Second Embodiment, FIG. 6

Referring next to FIG. 6, the second embodiment of the present invention will be described. Since the second embodiment is substantially similar in construction to the first embodiment described above, only the differences between them will be described.

As shown in FIG. 6, one or more engaging pins are radially inwardly extended into the second knuckle cylinder 8, whereby an engaging step 11 similar to that of the first embodiment is formed. The pin 6 is rotatably fitted into the second knuckle cyliner 8 below the engaging step 11.

As is the first embodiment, the short cylindrical load plug 12 is slidably fitted into the second knuckle cylinder 8 above the engaging step 11 or retaining pin or pins. A multiple disk spring 14 (that is, a spring consisting of series-connected disk springs) is loaded between the load plug 12 and the plug or cap 13 fitted at the upper end of the second knuckle cylinder 8. Under the force of the multiple disk spring 14, the load plug 12 is forced toward the upper end of the pin 6, but under the normal condition, the load plug 12 remains at its normal position at which the load plug 12 is in engagement with the engaging step 11 formed the pin or pins. As is the first embodiment, it is preferable that the force of the multiple disk spring 14 be 10–20 Kg greater than one half of the weight of the door 4 which is applied through the pin 6 to the load plug 12.

The effects, features and advantages of the second embodiment are substantially similar to those of the first embodiment.

Figure 7:
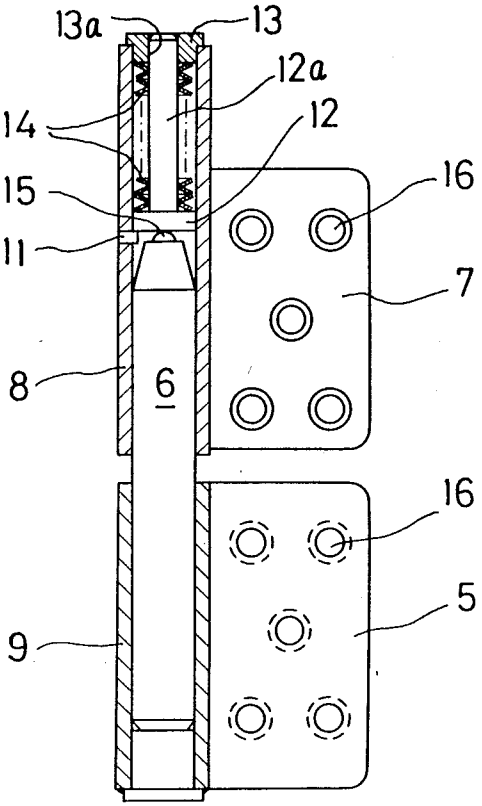
FIGS. 5 through 14 show, partly in section, first through tenth embodiments, respectively, of an earthquake-proof hinge in accordance with the present invention.

Third Embodiment, FIG. 7

Referring next to FIG. 7, the third embodiment of the present invention will be described. The load plug 12 is made thin and the lower end of a guide rod 12*a* is securely fixed to the upper surface of the load plug 12. The guide rod 12*a* is extended upwardly in coaxial relationship with the second knuckle cylinder 8 and extended through a guide hole 13*a* formed in the cap or plug 13 at the upper end of the second knuckle cylinder 8. Therefore the load plug 12 and its guide rod 12*a* are guided by the inner cylindrical bore surface of the second knuckle cylinder 8 and the cap or plug 13 at the top end thereof. The multiple disk spring 14 is loaded between the load plug 12 and the cap or plug 13 as is the case of the second embodiment and the guide rod 12*a* is extended through the multiple disk spring 14.

The effects, features and advantages of the third embodiment are substantially similar to those of the second embodiment described above with reference to FIG. 6. However, it should be noted that smooth movement of the load plug 12 is ensured because the guide rod 12*a* of the load plug 12 is guided by the hole 13*a* of the cap or plug 13. In addition, since the load plug 12 is thin, the length of the multiple disk spring 14 can be increased. As a result, the length of the extension of the second knuckle cylinder 8 beyond the upper side edge of the second metal plate 7 can be reduced when the number of disk springs is the same as the disk springs used in the second embodiment (See FIG. 6). Furthermore, the length of the pin 6 fitted into the second knuckle cylinder 8 can be increased. Therefore, the door 4 can be smoothly opened or closed. If the extension of the second knuckle cylinder 8 beyond the upper side edge of the second metal plate 7 and the length of the pin 6 fitted into the second knuckle cylinder 7 are same as the second embodiment (See FIG. 6), then the number of disk springs 14 can be increased and consequently the spring constant of the multiple disk spring 14 can be decreased accordingly. As a result, the initial compression of the multiple disk spring can be increased and the normal compressive force can be made equal to that of a multiple disk spring consisting of a small number of disk springs. Consequently, the force for displacing the load plug 12 can be decreased so that the operation of the earthquake-proof hinge is greatly facilitated. Furthermore, since the guide rod 12*a* is extended through the multiple disk spring 14, the disk springs can be maintained aligned with each other so that the operation of the multiple disk spring can be further ensured.

Figure 8:
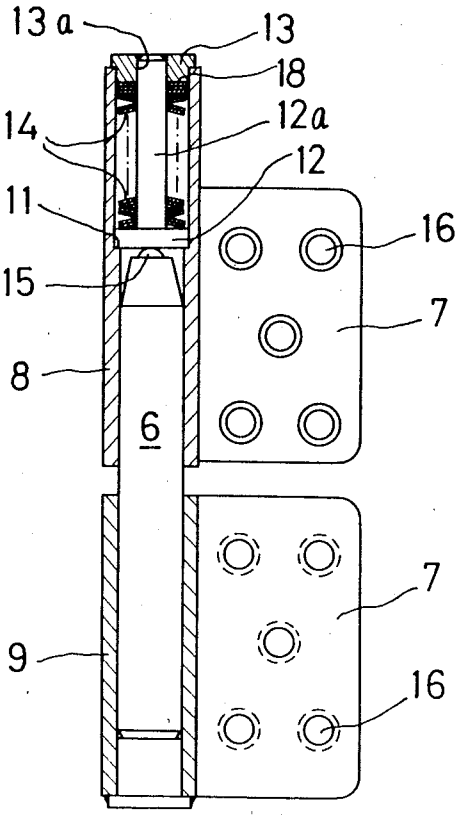

Fourth Embodiment, FIG. 8

The fourth embodiment as shown in FIG. 8 is substantially similar in construction to the third embodiment as shown in FIG. 7 except (a) that the multiple disk spring 14 comprises a plurality of disk spring units each consisting of two overlapped disk springs and (b) that a washer 18 is interposed between the upper end of the multiple disk spring 14 and the lower end of the cap or plug 13. The function, effects, features and advantages of the fourth embodiment are substantially similar to those of the third embodiment described above with reference to FIG. 7.

Since each disk spring unit comprises two overlapped disk springs, the spring constant of the multiple disk spring 14 can be increased. Furthermore, since the washer 18 is interposed, the initial compression of the multiple disk spring 14 can be increased. As a result, opposed from the embodiments where the compression spring and the conical helical spring are used, various factors of the multiple spring 14 can be arbitrarily selected depending upon the weight of a door used by changing the number of disk springs and their arrangement without designing and fabricating a special spring.

Figure 9:
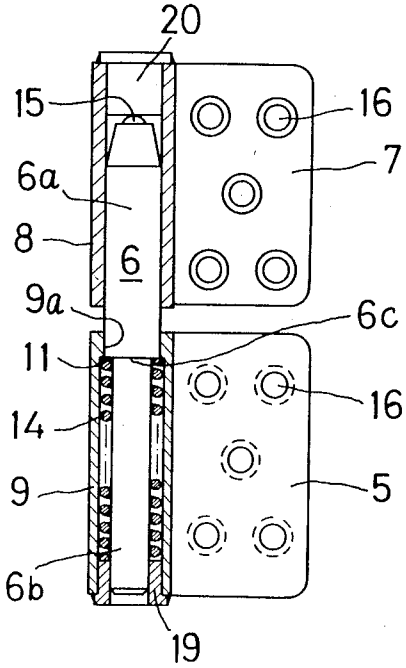

Fifth Embodiment, FIG. 9

One long side edge of the first plate 5 is formed integral with the first knuckle cylinder 9 whose both ends are opened. The inner diameter of the upper end of the first knuckle cylinder 9 is smaller than that of the lower end thereof. The engaging step 11 is formed within the first knuckle cylinder 9 adjacent to the upper end thereof.

The lower end of the first knuckle cylinder 9 is closed with a plug 19 having a flange. The plug 19 can be securely fixed to the lower end of the first knuckle cylinder 9 by welding or the like.

According to the fifth embodiment, the pin 6 has a large diameter portion 6*a* and a small diameter portion 6*b* which is rotatably and slidably fitted into the first knuckle cylinder 9. The lower end of the pin 6 is received in a recess in the lower plug 19. The lower end portion of the large diameter portion 6*a* of the pin 6 is rotatably and slidably received in the large diameter portion 9*a* of the first knuckle cylinder 9.

The previously compressed compression spring 14 is loaded in the annular space defined by the small diameter portion 6b of the pin 6 and the inner wall surface of the first knuckle cylinder 9. The lower end of the compression spring 14 is abutted against the inner end surface of the lower plug 19, and the upper end thereof against the engaging step 11. Therefore, the compression spring 14 is retained in its normal position unless an excessive force is exerted on the pin 6.

The step 6c between the large diameter and small diameter portions 6a and 6b engages with the upper end of the compression spring 14. That is, the stepped portion 6c and the engaging step 11 are in coplanar relationship with each other. Therefore the position of the lower end of the large diameter portion 6a of the pin within the first knuckle cylinder 9 is uniquely determined by the position of the compression spring 14. It is of course apparent that the compression spring 14 is loaded into the first knuckle cylinder 9 before the lower plug 19 is welded or otherwise fixed to the lower end of the first knuckle cylinder 9.

One long side of the second metal plate 7 is formed integral with the second knuckle cylinder 8 whose both ends are opened. The large diameter portion 6a of the pin 6 is rotatably and slidably fitted into the second knuckle cylinder 8. A cap or plug 20 is fitted over the upper end of the second knuckle cylinder 8 by welding or the like.

The upper end of the pin 6 is brought into engagement with the lower surface of the cap or plug 20 and functions as a thrust bearing. That is, the upper end of the pin 6 supports the load of the door.

The length of the pin 6 is so determined that when the upper end of the pin 6 is brought to engagement with the lower surface of the cap or plug 20 and the stepped portion 6c of the pin 6 is brought into engagement with the upper end of the compression coil 14, the lower end of the second knuckle cylinder 8 and the upper end of the first knuckle cylinder 9 are spaced apart from each other by 5–6 mm as is the case of the first embodiment. Also as described hereinbefore, it is preferable that the force of the compression spring 14 is for instance 10–20 Kg greater than the load applied to the pin 6 in its axial direction under the normal condition.

When a force is applied to the gate frame 1 in the direction ⊕ as shown in FIG. 2, the gate frame 1 is distorted so that the upper side edge of the door 4 is brought into engagement with the upper side edge of the gate frame 1. As a result, the force applied to the gate frame 1 is transmitted to the earthquake-proof hinges through the door 4. As a result, the first and second metal plates 5 and 7 are forced to move toward each other so that the compression coil spring 14 is compressed. Therefore, the pin 6 is forced to move downwardly into the first knuckle cylinder 9 so that as shown in FIG. 2 the door 4 is moved downwardly relatively to the gate frame 1. As a result interference between the door and the gate frame can be eliminated so that the door can be easily opened.

When, as shown in FIG. 3, the force is applied to the gate frame 1 in the direction ⊖, the lower side edge of the gate frame 1 is forced into engagement with the lower side edge of the door 4. Then the pin 6 is forced to pull out of the second knuckle cylinder 8 or the first knuckle cylinder 9. As a result, the door 4 is forced to move upwardly of the gate frame 1 so that the interference between the door 4 and the gate frame 1 is eliminated.

Figure 10:
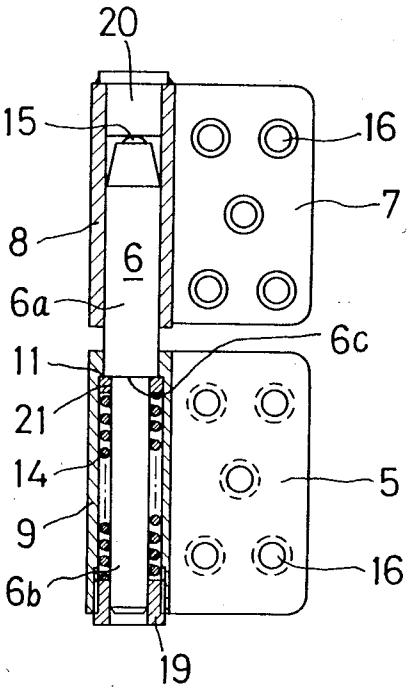

Sixth Embodiment, FIG. 10

The sixth embodiment as shown in FIG. 10 is substantially similar in construction to the fifth embodiment described above except that an annular sliding ring 21 having a rectangular cross sectional configuration is slidably interposed between the upper end of the compression spring 14 and the stepped portion 6c of the pin 6' and that the lower plug 19 is threadably engaged with the lower end of the first knuckle cylinder 9.

The function, effects, features and advantages of the sixth embodiment are substantially similar to those of the fifth embodiment, but the sixth embodiment is advantageous in that since the sliding ring 21 makes intimate contact with the stepped portion 6c of the pin 6 or the engaging step 11, the upper end of the compression spring 14 can securely engage with the engaging portion or the stepped portion 6c of the pin 6.

In addition, the lower plug 19 can be loosened and removed from the first knuckle cylinder 9 so that the door can be readily opened or closed after the hinge has accomplished its function as an earthquake-proof hinge. That is, when the gate frame 1 is distorted as shown in FIG. 2 due to an earthquake or the like, the compression spring 14 is compressed so that the door 4 is forced to move downwardly with respect to the gate frame 1. When one enters a room after an earthwuake or the like and then tries to close the door, the compression coiled spring 14 is returned to its normal position so that the door 4 is in the raised position. As a result, the gate frame 1 and the door 4 interfere with each other so that the door 4 cannot be closed. In this case, the lower plug 9 is loosened so that the force of the compression coiled spring 14 is decreased. Then, due to the weight of the door itself, the door is moved downward so that the interference between the gate frame 1 and the door is eliminated.

Figure 11:
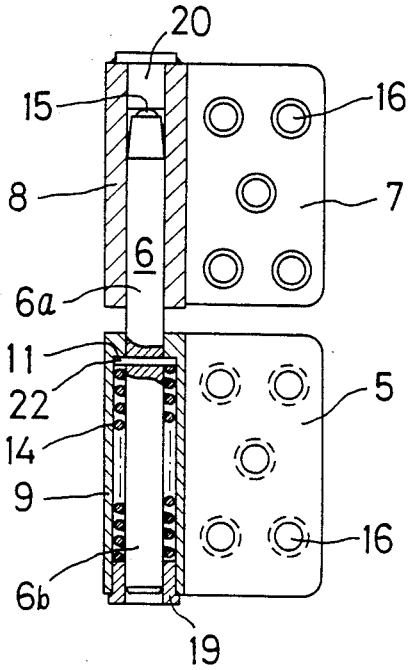

Seventh Embodiment, FIG. 11

The seventh embodiment as shown in FIG. 11 is substantially similar in construction to the fifth embodiment as shown in FIG. 9 except (a) that the pin 6 has the same diameter over its whole length and (b) that an engaging pin 22 is extended through the pin 6 diametrically thereof adjacent to the engaging step 11 of the first knuckle cylinder 9. Therefore the upper end of the compression coiled spring 14 is brought into engagement with the engaging pin 22 and with the stepped portion 11 of the first knuckle cylinder 9. The function, effects, features and advantages of the seventh embodiment are substantially similar to those of the fifth embodiment.

It is to be understood that it is not needed to extend the engaging pin 22 through the pin and that one or more pins may be extended from the cylindrical surface of the pin 6 in the radially outward direction.

Figure 12:
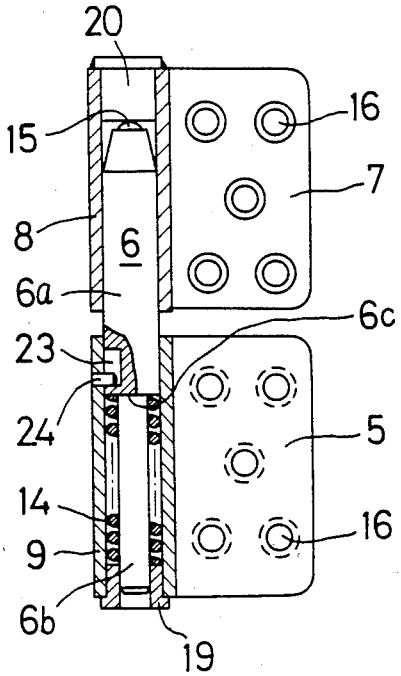

Eight Embodiment, FIG. 12

The eight embodiment as shown in FIG. 12 is substantially similar in construction to the fifth embodiment as shown in FIG. 9 except that an elongated groove 23 is formed in the pin 6 and extended in the axial direction thereof and that a stopper pin 24 is extended radially inwardly through the wall of the first knuckle cylinder 9 into the elongated groove 23. The length of the elongated groove 23 is so determined that when the upper end of the first knuckle cylinder 9 and the lower end of the second knuckle cylinder 8 abut against each other, the stopper pin 24 will not interfere with the elongated groove 23.

As shown in FIG. 12, when the compression coiled spring 14 is not compressed, its upper end is brought into engagement with the stepped portion 6*c* of the pin 6, but the pin 6 itself is brought into engagement with the stopper pin 24 so that the compression coiled spring 14 is substantially engaged with the stopper pin 24.

The function, effects, features and advantages of the eighth embodiment are substantially similar to those of the fifth embodiment as shown in FIG. 9, but it should be noted that the rotation about its axis of the pin 6 is prevented by the stopper pin 24.

It is to be understood that the stopper pin 24 may be extended diametrically through the pin 6 and in this case, instead of the elongated groove 23, an axially elongated slot is formed.

Figure 13:
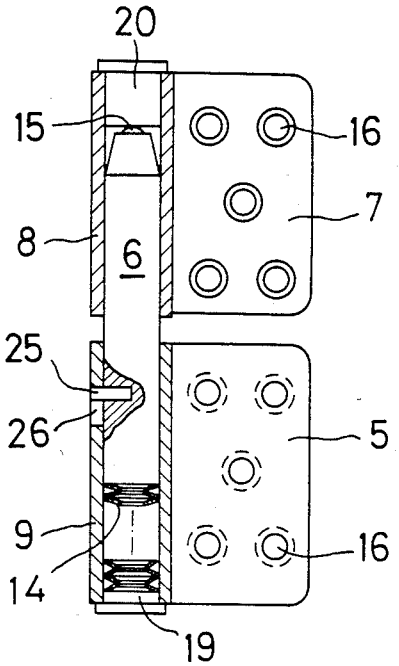

Ninth Embodiment, FIG. 13

The ninth embodiment as shown in FIG. 13 is substantially similar in construction to the seventh embodiment as shown in FIG. 11. Instead of the compression coiled spring, the multiple disk spring 14 is loaded in the first knuckle cylinder 9 between the lower end of the pin 6 and the lower plug 19.

An axially elongated slot 26 is formed through the wall of the first knuckle cylinder 9 and a pin or stopper 25 extended from the pin 6 is slidably fitted into the axially elongated slot 26. The length of the axially elongated slot 26 is determined as in the case of the elongated slot 23 of the eighth embodiment.

The function, effects, features and advantages of the ninth embodiment are substantially similar to those of the seventh embodiment, but it is to be understood that each disk spring exhibits a strong force so that the multiple disk spring 14 easily attain an elastic deformation of the order of 5–6 mm. In other words, the multiple disk spring 14 can be disposed compactly between the lower plug 19 and the lower end of the pin 6. This means that it is not necessary to reduce the diameter of the pin 6 in order to house the compression coiled spring. Moreover, it is not necessary to decrease the wall thickness of the first knuckle cylinder 9. Thus the ninth embodiment has an advantage that the strength of the earthquake-proof hinge can be increased.

Figure 14:
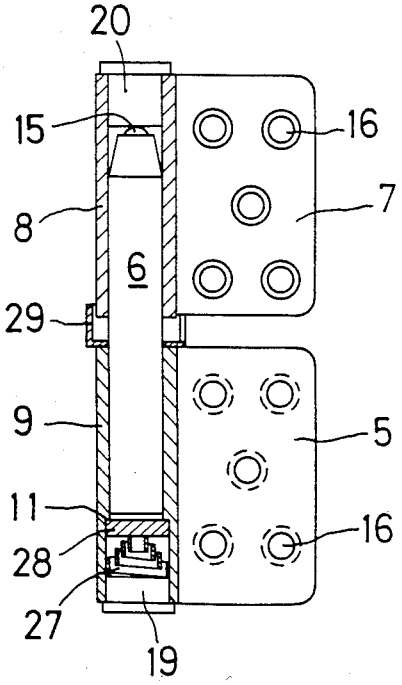

Tenth Embodiment, FIG. 14

In the tenth embodiment, instead of the compression coiled spring or multiple disk spring 14, a conical helical spring 27 is loaded between the lower plug 19 and the lower end of the pin 6 through a spring retainer 28 which is in engagement with the engaging step 11 formed in the first knuckle cylinder 9 adjacent to the lower end thereof.

The function, effects, features and advantages of the tenth embodiment is similar to those of the fifth embodiment, but it is to be noted that even if it is small, the conical helical spring 27 exhibits a strong force. As a result, as in the case of the ninth embodiment, the conical helical spring 27 can be compactly loaded between the lower plug 19 and the lower end of the pin 6. Therefore there is an advantage that the strength of the earthquake-proof hinge can be increased.

In the tenth embodiment, a pin cover 29 is fitted over the pin 6. (It is to be noted that the pin cover 29 is not a component part of the present invention.) The pin cover 29 is provided in order to prevent the exposure of the pin 6 between the first and second knuckle cylinders 9 and 8 so that the earthquake-proof hinge in accordance with the present invention has an outer appearanc similar to that of the conventional hinge.

Figure 15:
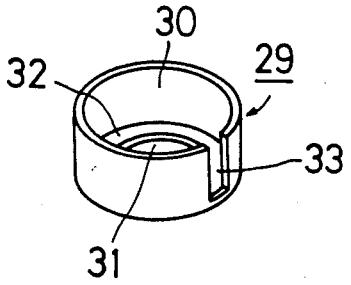
FIG. 15 is a perspective view, on enlarged scale, of a pin cover used in the tenth embodiment as shown in FIG. 14.

As shown in FIG. 15, the pin cover 29 is in the form of a cup and comprises a cylindrical portion 30 which is fitted over the second knuckle cylinder 8 and a bottom 32 having a center aperture 31 into which is fitted the pin 6. The cylindrical portion 30 is formed with an axially extended slit 33 whose width is slightly greater than the thickness of the second metal plate 7 (See FIG. 14).

As shown in FIG. 14, the bottom 32 of the pin cover 29 is placed on the upper end of the first knuckle cylinder 9 in coaxial relationship therewith and then the cylindrical portion 30 of the pin cover 29 is fitted over the second knuckle cylinder 8 while the pin 6 is fitted into the center aperture 31. Said one long side edge of the second metal plate 7 is fitted partially into the slit 33 of the pin cover 29. As described above, the function of the pin cover 29 is to prevent the exposure of the pin 6 so that no further detailed explanation shall be made in this specification. However, it is apparent that if the pin cover 29 is fitted over the hinge, the distance between the lower end of the second knuckle cylinder 8 and the upper end of the first knuckle cylinder 9 must be increased by the distance equal to the thickness of the bottom 32 (See FIG. 15) of the pin cover 29.

Figure 16:
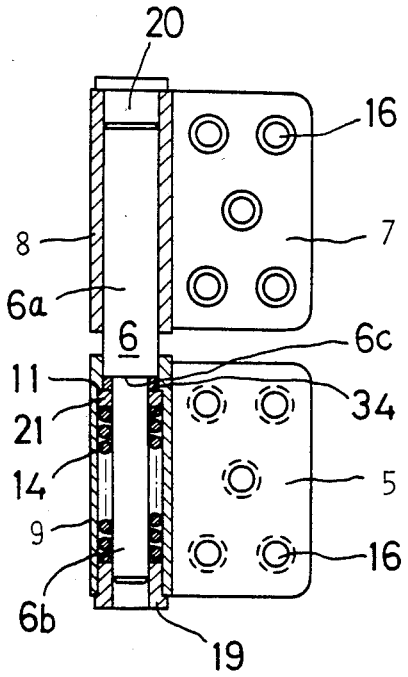
FIGS. 16 through 18 show, partly in section, eleventh through thirteenth embodiments, respectively, of the present invention.

Eleventh Embodiment, FIG. 16

The eleventh embodiment as shown in FIG. 16 is substantially similar in construction to the fifth embodiment except that the large diameter portion 6*a* of the pin 6 is securely press fitted into the second knuckle cylinder 8 formed integral with the first metal plate 7 while the small diameter portion 6*b* of the pin 6 is rotatably and slidably fitted into the first knuckle cylinder 9 formed integral with the second metal plate 7.

The inner diameter of the upper end portion of the first knuckle cylinder 9 is smaller than that of the lower end portion thereof so that an engaging step 11 is formed.

The lower plug 19 with a flange is securely welded or otherwise fixed to the lower end of the first knuckle cylinder 9.

The compression coiled spring 14 which is previously compressed is fitted into the annular space between the small diameter portion 6*b* of the pin 6 and the inner wall surface of the first knuckle cylinder 9. The lower end of the compression coiled spring 14 is engaged with the inner (upper) end of the lower plug 19 while the upper end thereof is engaged with the engaging step 11 through the sliding ring 21. Thus the position of the compression coiled spring 14 is securely maintained within the first knuckle cylinder 9 unless an excessive force is applied to the hinge. It is apparent that the compression coiled spring 14 is inserted into the first knuckle cylinder 9 before the lower plug 19 is securely attached to the lower end thereof.

The sliding ring 21 is rotatably fitted over the small diameter portion 6*b* of the pin 6 and is brought into engagement with the stepped portion 6*c* of the pin 6 through a thrust bearing 34 in the form of a ring. It is preferable that the thrust bearing ring 34 be made of a material such as oilless metal or teflon with a low coefficient of friction and a high degree of strength.

As described above, the position of the stepped portion 6*c* of the pin 6, the engaging step 11 of the first cylinder 9 and the thickness of the thrust bearing ring 34 are so determined that when the thrust bearing ring 34 is brought into intimate contact with the stepped portion 6c of the pin 6 and with the sliding ring 21, the upper end of the first knuckle cylinder 9 and the lower end of the second knuckle cylinder 8 are spaced apart from each other by 5–6 mm.

The force of the compression coiled spring 14 is greater than the load axially applied to the pin 6 by 10–20 Kg as described before.

It is assumed that the door 4 is supported by two earthquake-proof hinges in accordance with the present invention. When the gate frame 1 is not distorted, each of the hinges receives about one half of the weight of the door when the hinges are installed in an ideal manner. The load applied to the hinge is supported by the gate frame 1 through the second metal plate 7, the second knuckle cylinder 8, the pin 6, the thrust bearing ring 34, the sliding ring 21, the compression coiled spring 14, the first knuckle cylinder 9 and the first metal plate 5.

The interface between the stepped portion 6c of the pin 6 and the thrust bearing ring 34 serves as a thrust bearing surface so that the door can be readily and smoothly opened or closed. Since the force of the compression coiled spring 14 is greater than the load applied axially to the pin 6, the thrust bearing ring 34 is securely fixed within the first knuckle cylinder 9.

When force is applied due to an earthquake or the like to the gate frame 1 in the direction indicated by ⊕, the gate frame 1 is distorted so that the upper side edge of the door 4 engages with the upper side edge of the gate frame 1. As a result, the force applied to the gate frame 1 is transmitted through the door 4 to the earthquake-proof hinges. This force causes the first and second metal plates 5 and 7 to move toward each other so that the compression coiled spring 14 is compressed.

As a result, the pin 6 is caused to move into the first knuckle cylinder 9 so that as shown in FIG. 2 the door 4 can be moved downwardly of with respect to the gate frame 1, whereby the interference between the gate frame 1 and the door 4 is eliminated and consequently the door 4 can be easily opened.

When the force is applied to the gate frame 1 in the direction as indicated by ⊕, the lower side of the gate frame 1 is engaged with the lower side edge of the door 4. The force applied to the door 4 forces the pin 6 to be pulled out of the first knuckle cylinder 9 so that the door 4 can be moved upwardly relative to the gate frame and consequently the interference between the gate frame 1 and the door 4 is eliminated.

Figure 17:
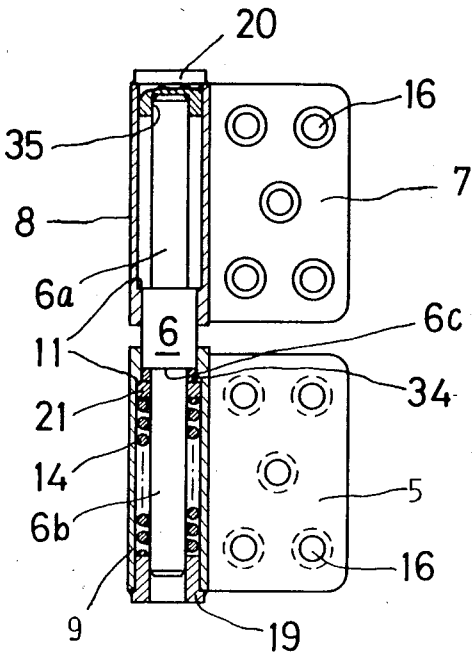

Twelfth Embodiment, FIG. 17

The twelfth embodiment as shown in FIG. 17 is substantially similar in construction to the eleventh embodiment as shown in FIG. 16 except that the second metal plate 7 and its second knuckle cylinder 8 are interchangeable with the first metal plate 5 and its first knuckle cylinder 9. That is, the first and second metal plates 5 and 7 and the first and second knuckle cylinders 9 and 8 are identical in construction and size. Furthermore the pin 6 consists of an upper small diameter portion 6a, a large diameter portion and a lower small diameter portion 6b. That is, the upper and lower small diameter portions 6a and 6b are symmetrical about the large diameter portion.

An upper plug 20 is fitted over the upper end of the second knuckle cylinder 8 and its inner end is formed with a recess 35 for receiving the upper end of the upper small diameter portion 6a of the pin 6. The upper end of the upper smaller diameter portion 6a of the pin 6 is pressed fitted into the recess 35 of the upper plug 20 so that the second metal plate 7 can be moved in unison with the pin 6.

The function, effects, features and advantages of the twelfth embodiment are substantially similar to those of the eleventh embodiment as shown in FIG. 16, but it should be noted that the first and second metal plates 5 and 7 and the first and second knuckle cylinders 9 and 8 are identical so that the fabrication of the hinges is greatly facilitated. Furthermore, the pin 6 is symmetrical with respect to the center thereof as described above so that it is not needed to determine which portion of the pin 6 is inserted into the first or second knuckle cylinder 9 or 8. As a result, the automatic assembly of earthquake-proof hinges can be carried out.

It has been described that the upper end of the upper small diameter portion 6a of the pin 6 is press fitted into the recess 35, but it is to be understood that the upper end of the small diameter portion 6a may be loosely fitted into the recess 35. In the latter case, the pin 6 can be rotated relative to the second knuckle cylinder 8. In practice, the thrust bearing ring 34 and the lower stepped portion 6c of the pin 6 act as a thrust bearing with a lesser frictional moment. In addition, even when the upper end of the pin 6 and the recess 35 act as a thrust bearing, it will not adversely affect the function of the earthquake-proof hinge.

Figure 18:
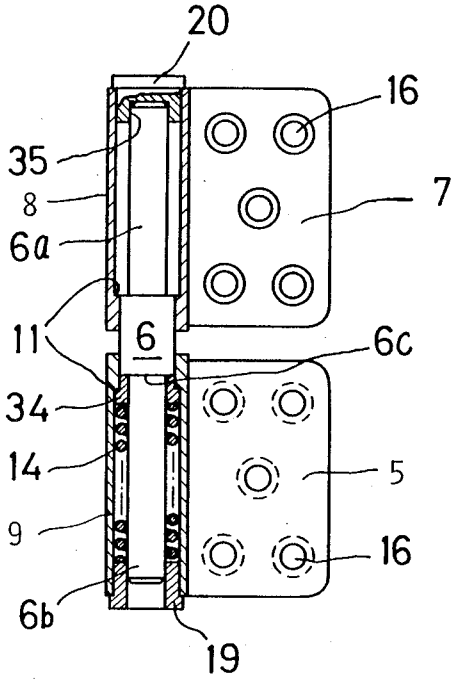

Thirteenth Embodiment, FIG. 18

The thirteenth embodiment as shown in FIG. 18 is substantially similar in construction to the twelveth embodiment as shown in FIG. 17 except that the thrust bearing ring 34 and the sliding ring 21 are formed integral. The thrust bearing ring 34 is preferably made of a material such as an oilless metal or Teflon with a low coefficient of friction and with a higher degree of strength as described before.

The function, effects, features and advantages of the thirteenth embodiment are substantially similar to those of the twelveth embodiment, but it should be noted that since the thrust bearing ring 34 is brought into engagement with the stepped portion 11 of the first knuckle cylinder 9, even when the pin 6 is pulled out of the first knuckle cylinder 9, the thrust bearing ring 34 is prevented from falling therefrom. Therefore, this arrangement is advantageous when the first knuckle cylinder 9 is turned upside down for installation.

What is claimed is:

1. A door hinge which facilitates the opening of a door after there has been relative distortion of said door and the gate frame to which said door hinge is attached, comprising first and second vertically spaced metal plates each having a vertically oriented side edge, one of said first and second plates being attachable to said door and the other to said gate frame;

first and second vertically spaced knuckle cylinders formed integrally with said first and second metal plates, respectively, said second knuckle cylinder being positioned above said first knuckle cylinder with a clearance space therebetween, an engaging portion being provided within said second knuckle cylinder;

a pin slidably extending through said first and second knuckle cylinders, said first and second knuckle cylinders being axially displaceable with respect to each other along said pin;

a load plug slidably inserted within said second knuckle cylinder and resting on the engaging portion thereof, said load plug contacting the upper end of said pin; and compression spring means positioned within said second knuckle cylinder above said load plug, the force exerted by said compression spring means being greater than the load normally applied axially by the weight of said door on said pin in the absence of relative distortion between said door and said gate frame, whereby said load plug is pressed against said engaging portion and the load applied axially by the weight of said door to said pin is carried by said compression spring means, said knuckle cylinders being axially displaced with respect to each other when relative distortion occurs between said door and said gate frame.

2. A door hinge as set forth in claim 1 wherein said load plug comprises a disk-shaped main body and a guide rod extending from the upper surface of said main body in coaxial relation therewith, said door hinge further comprising a cap having an aperture therein through which said guide rod extends.

3. A door hinge as set forth in claim 1 wherein said compression spring means comprises a coiled spring.

4. A door hinge as set forth in claim 1 wherein said compression spring means comprises a multiple disk spring.

5. A door hinge as set forth in claim 1 wherein said load plug comprises a cylinder which is short relative to the length of said pin.

6. A door hinge which facilitates the opening of a door after there has been relative distortion of said door and the gate frame to which said door hinge is attached, comprising first and second vertically spaced metal plates each having a vertically oriented side edge, one of said first and second plates being attachable to said door and the other to said gate frame;

first and second vertically spaced knuckle cylinders formed integrally with said first and second metal plates, respectively, said second knuckle cylinder being positioned above said first knuckle cylinder with a clearance space therebetween, said first knuckle cylinder being provided with a spring retaining means and the upper end of said second knuckle cylinder being closed;

a pin having lower and upper portions and an engaging portion, said pin slidably extending within said second knuckle cylinder and said first and second knuckle cylinders being axially displaceable with respect to each other along said pin, the load applied by the weight of said door acting axially on said pin and being carried by the engagement of the end of the upper portion of said pin with the closed upper end of said second knuckle cylinder;

spring means positioned within said first knuckle cylinder and engaging the engaging portion of said pin for transmitting the load applied by the weight of said door to said spring means, the force exerted by said spring means being greater than the load normally applied axially by the weight of said door on said pin in the absence of relative distortion between said door and said gate frame, the position of said spring means in the absence of said distortion being determined by said spring retaining means.

7. A door hinge as set forth in claim 6 wherein said spring means comprises a multiple disc spring, the lower portion of said pin has a smaller diameter than the upper portion thereof and the engaging portion of said pin is a stepped portion at the boundary between said upper and lower portions, said hinge further comprising a plug closing the lower end of said first knuckle cylinder, said multiple disc spring being interposed between the stepped portion of said pin and said plug.

8. A door hinge as set forth in claim 6 wherein said spring means comprises a conical helical spring, said hinge further comprising a plug closing the lower end of said first knuckle cylinder, and said conical helical spring being interposed between the lower end of the lower portion of said pin and said plug.

9. A door hinge as set forth in claim 6 wherein the lower portion of said pin has a smaller diameter than the upper portion thereof and the engaging portion of said pin is a stepped portion at the boundary between said upper and lower portions, said hinge further comprising a sliding ring surrounding the lower portion of said pin and being in engagement with said stepped portion.

10. A door hinge as set forth in claim 6 wherein said spring retaining means comprises the boundary between an upper portion of said first knuckle cylinder having a smaller inner diameter than the lower portion thereto, said hinge further comprising a plug closing the lower end of said first knuckle cylinder, said spring means being interposed between said spring retaining means and said plug.

11. A door hinge as set forth in claim 6 wherein said spring retaining means comprises a stopper pin extending radially through the wall of said first knuckle cylinder and said pin has an axially elongated groove therein for slidably receiving said stopper pin, said hinge further comprising a plug closing the lower end of said first knuckle cylinder, said spring means being interposed between said spring retaining means and said plug.

12. A door hinge as set forth in claim 6 wherein said spring retaining means comprises an elongated axial slot in the wall of said first knuckle cylinder, and said pin is provided with a stopper member extending radially from said pin and sliding within the slot in said first knuckle cylinder, said hinge further comprising a plug closing the lower end of said first knuckle cylinder, said spring means being interposed between said stopper member and said plug.

13. A door hinge as set forth in claim 6 wherein said spring means comprises a compression coiled spring fitted over the lower half portion of said pin.

14. A door hinge as set forth in claim 6 wherein the engaging portion of said pin is a stepped portion thereof.

15. A door hinge as set forth in claim 6 wherein the engaging portion of said pin is an engaging pin extended therefrom.

16. A door hinge which facilitates the opening of a door after there has been relative distortion of said door and the gate frame to which said door hinge is attached, comprising first and second vertically spaced metal plates each having a vertically oriented side edge, one of said first and second plates being attachable to said door and the other to said gate frame;

first and second vertically spaced knuckle cylinders formed integrally with said first and second metal plates, respectively, said second knuckle cylinder being positioned above said first knuckle cylinder with a clearance space therebetween;

a pin extending through said first and second knuckle cylinders, said first and second knuckle cylinders being axially displaceable with respect to each other along said pin, said pin having an upper portion and a lower portion wherein the lower portion has a smaller diameter than the upper portion thereby forming a stepped portion at the boundary between said upper and lower portions, the lower portion of said pin being slidable axially within said first knuckle cylinder;

a compression coiled spring surrounding said pin and having both ends in contact with said first knuckle cylinder, the force exerted by said compression coiled spring being greater than the load normally applied axially by the weight of said door on said pin in the absence of relative distortion between said door and said gate frame; and a thrust bearing interposed between one end of said compression coiled spring and the stepped portion of said pin.

* * * * *